United States Patent [19]

Iwasaki

[11] Patent Number: 5,002,799

[45] Date of Patent: Mar. 26, 1991

[54] METHOD FOR MANUFACTURING ANTI-STATIC CATHODE RAY TUBES

[75] Inventor: Yasuo Iwasaki, Nagaokakyo, Japan

[73] Assignee: Mitsubishi Denki Kabushiki Kaisha, Tokyo, Japan

[21] Appl. No.: 405,969

[22] Filed: Sep. 12, 1989

[30] Foreign Application Priority Data

Sep. 29, 1988 [JP] Japan ..... 63-247662
Sep. 29, 1988 [JP] Japan ..... 63-247663

[51] Int. Cl.[5] ..... B05D 5/12

[52] U.S. Cl. ..... 427/72; 427/64; 427/106; 427/108; 427/126.2; 427/126.3; 427/167; 427/227; 427/240

[58] Field of Search ..... 427/72, 64, 106, 108, 427/126.2, 126.3, 226, 167, 240

[56] References Cited

U.S. PATENT DOCUMENTS 4,723,091 2/1988 Kawamura et al. ..... 312/478
4,908,232 3/1990 Itou et al. ..... 427/72

FOREIGN PATENT DOCUMENTS 0288982 2/1988 European Pat. Off. .
449741 7/1936 United Kingdom .
1348087 3/1974 United Kingdom .
2161320 1/1986 United Kingdom .

*Primary Examiner*—Janyce Bell
*Attorney, Agent, or Firm*—Birch, Stewart, Kolasch & Birch

[57] ABSTRACT

In manufacturing anti-static cathode ray tubes, the concentration of a conducting filler dispersed in the coating solution is so set that a surface resistance lies within a fixed range. The baking step of the anti-static treatment is integrated in the conventional heat treatment of cathode ray tubes. Further, the salvage cap used to receive splashes of coating solution is rotated in synchronization with the tube.

16 Claims, 9 Drawing Sheets

1: $SiO_2$ (SILICA) MATRIX
2: CONDUCTING FILLER PARTICLES

METHOD FOR MANUFACTURING ANTI-STATIC CATHODE RAY TUBES

BACKGROUND OF THE INVENTION

This invention is directed to a method for the preparation of anti-static films on glass surfaces. More particularly, this invention relates to a method of manufacturing anti-static cathode ray tubes wherein adhesion of airborne dirt and unpleasant static discharges on the external surface of the face plate of the tube due to accumulation of static electricity are prevented by subjecting the face plate to anti-static treatment.

In recent years, due to the increased size, improved brightness and focus characteristics of cathode ray tubes, the voltage applied to the fluorescent surface of the tube, i.e. the acceleration voltage of the electron beam, is higher than it was in the earlier devices. In a conventional 21" color cathode ray tube, for example, this voltage was of the order of 25–27 KV, however in recent color tubes of 30" or larger size, the voltage is as high as 30–34 KV. The external surface of the face plate of the tube is therefore liable to suffer a charge build-up, especially when the television set is turned ON and OFF. As a result of this charge, fine airborne dirt adheres to the face plate. The dirt is easily noticed, and leads to a deterioration of the brightness of the color cathode ray tube. Further, when viewers approach the face plate of the tube, there is a discharge of static electricity from the face plate which is very uncomfortable.

FIG. 6 is a graph showing the variation of surface potential of the face plate of a cathode ray tube. In the figure, L is the curve of potential variation when the set is switched ON, and L1 is the curve of potential variation when the set is switched OFF.

In recent years, cathode ray tubes receive an anti-static treatment whereby, to avoid this accumulation of charge on the external surface of the face plate, a smooth transparent conducting film is formed on the plate so that the charge can escape to ground.

FIG. 5 is a drawing which describes the principle of the anti-static treatment of the cathode ray tube. In the figure, 6 is the neck of the tube which contains the electron gun (not shown in the figure). 7 denotes deflection yokes, 13 is a funnel, 4 is the face plate and 5 is a high voltage button. The deflection yokes 7 are connected to the deflection power supply via a lead wire 7*a*, the electron gun is connected to the drive power supply via a lead wire 6*a*, and the high voltage button 5 is connected to a high voltage power source via a lead wire 5*a*.

In the cathode ray tube of the above construction, the electron beam emitted by the electron gun inside the neck 6 is deflected electromagnetically from outside the tube by the deflection yokes 7, and a high voltage is applied at the same time to the fluorescent surface on the inner surface of the face plate 4 by means of the high voltage button 5. The electron beam is therefore accelerated, and its energy excites the fluorescent surface to cause emission of light. However, due to the high voltage applied to the fluorescent surface, the potential of the external surface of the face plate 4 changes, and dirt adheres to the plate.

To avoid adhesion of dirt, therefore, as shown in FIG 5, a smooth transparent conducting film 11 is formed on the face plate 4. As the film 11 is grounded, any charges on the plate escape continually to ground, and accumulation of charge on the plate is prevented.

In the anti-static cathode ray tube 3 shown in FIG. 5, the grounding of the transparent conducting film 11 on the external surface of face plate 4, is accomplished by electrically connecting the metal anti-implosion band 8 wound around the side wall of face plate 4 and the transparent conducting film 11 by means of a conducting tape 12. The anti-implosion band 8 is connected to ground 10A by means of a ground wire 10 attached to fixing lugs 9, and the transparent conducting film 11 may therefore be grounded easily.

Curves M and M1 in FIG. 6 respectively show the potential variation of the external surface of the face plate in such an anti-static cathode ray tube 3 where a smooth, transparent conducting film 11 has been formed on the surface, when the power to the tube is switched ON and OFF, respectively. It is seen from this figure that the charge build-up is much less than in tubes which have not been so treated.

The smooth, transparent conducting film 11 formed on the surface of the face plate 4 must have a certain degree of hardness and adhesion, and silica ($SiO_2$)-type films are therefore generally used.

In the past, these silica-type smooth, transparent conducting films were formed by coating the face plate 4 uniformly and evenly with an alcohol solution of Si (silicon) alkoxides with —OH, —OR or other functional groups, for example by spin-coating. The films were then baked at a relatively low temperature, for example 100° C. or below.

The smooth, transparent conducting films 11 formed by the above method are porous and, as they contain silanol groups (≡Si—OH), their surface resistance is reduced by adsorption of airborne moisture. However, when these conventional films were baked at high temperature, the —OH of the silanol group was lost together with the moisture included in the pores. As a result, the surface resistance increased, and the desired conductivity could not be obtained. For this reason, baking must be carried out at low temperature, but in this case the film is not so strong. Further, if the films are used for long periods in a dry atmosphere, the moisture again escapes from the pores and the surface resistance increases with time. Moreover, once moisture has been lost from the pores, it does not easily re-enter them.

Conventional films thus suffered from the major disadvantages of poor strength and poor stability of electrical resistance with time. In order to overcome these drawbacks, metal atoms such as Zr (zirconium) were made to combine with the structure of the alkoxide in the coating solution so as to confer better conductivity, but this did not produce any great improvement.

The basic method of resolving these problems was to disperse a conducting filler of small particles of $SnO_2$ (stannic oxide) or $In_2O_3$ (indium oxide) in the alcohol solution of an Si (silicon) alkoxide, and adding minute quantities of P (phosphorus) or Sb (antimony) to the coating solution so as to confer semiconducting properties. By spin-coating the external surface of the face plate 4 of the cathode ray tube uniformly and evenly with such a solution, and then baking it at a fairly high temperature (e.g. 100° C. -200° C.), it was possible to increase the film strength, and to obtain a smooth, transparent conducting film 11 whose resistance did not change with time under any environmental conditions.

However, although an $SiO_2$ (silica) film made by dispersing a conducting filler in an alcohol solution of an Si (silicon) alkoxide as described above, does have the above advantages, it still has a major problem in its characteristics as will be discussed below.

The external surface of the face plate 4 of a cathode ray tube was coated with an alcohol solution of an Si (silicon) alkoxide to which minute particles of $SnO_2$ (stannic oxide) had been added in a proportion of 1.5 parts by weight with respect to the total weight of solution, and the coating was baked at 150° C. for 30 minutes to produce anti-static cathode ray tubes. When various tests were performed on the anti-static cathode ray tubes so obtained, it was found that the surface resistance was $5\times10^6\Omega$, the film strength was no less than 9H on the scale of lead pencil hardness, the surface resistance under dry conditions showed no variation at all, and the charge build-up when the television set was switched ON and OFF very closely resembled the characteristics shown by M and M1 in FIG. 6. It was however noticed that when the back of the hand was moved across the surface of the smooth, transparent conducting film 11 when the set was ON, a slight vibration was felt. This vibration was not the kind of shock felt when the face plate was charged. It was found to be a problem peculiar to silica ($SiO_2$) films in which a conducting filler was dispersed, and did not occur at all with conventional cathode ray tubes. Moreover, to some people, it was felt very uncomfortable.

The cause of this vibratory feeling was examined. It was found that when the coating was deposited by a wet process such as spin-coating an alcohol solution of an Si (silicon) alkoxide containing a dispersion of conducting filler particles, and the amount of filler increases, the particles cohere together rapidly when the coating dries. Viewed microscopically, as shown in FIG. 4, the filler particles 2 form a chain-like meshwork in an $SiO_2$ (silica) matrix 1. Viewed macroscopically, the smooth, transparent conducting film 11 has no charge build-up as the charge escapes to ground. Viewed microscopically, however, after the television set is switched ON, the potential on the surface of film 11 remains unequally distributed over the meshwork even after a considerable time has elapsed. If, therefore, the back of the hand is moved across the surface, a vibration is felt as if the back of the hand is shaking.

The spin-coating or other coating process which was used in view of their efficiency of production and easiness in handling of the cathode ray tubes, was carried out after a metal anti-implosion band 8 had been wrapped around the side wall of the face plate 4 of the tube.

FIG. 7A is a schematic diagram of the process steps used to manufacture the conventional cathode ray tube. In the figure, 20 is panel-mask assembly, 21 is panel-mask pair-bake, 22 is coat-deposition and aluminum deposition, 23 is panel bake, 24 is frittered glass sealing, 25 is gun sealing, 26 is evacuation, 27 is seasoning and aging, 28 is characteristics testing, 29 is anti-implosion treatment, and 30 is shipment. Cathode ray tubes are manufactured by process steps 20–30 in stated order.

FIG. 7B is a schematic diagram of the process steps used to manufacture the conventional anti-static cathode ray tube. As can be seen from the figure, in the conventional method used to manufacture the anti-static cathode ray tube, an anti-static treatment 31 is carried out between anti-implosion treatment 29 and shipment 30 in the manufacturing sequence for conventional tubes shown in FIG. 7A. This anti-static treatment 31 consists of coating with a solution, e.g. by means of spin-coating 31A, and baking 31B. As the other process steps are the same as in FIG. 7A, they are given identical numbers and their description will be omitted.

In the anti-static cathode ray tube with a smooth, transparent conducting film described above, therefore, a conducting filler was added to improve the strength of the film and prevent its surface resistance from varying with time. However, when the film was applied to the face plate by a wet method such as spin-coating, the conducting filler particles formed a chain-like meshwork in an $SiO_2$ (silica) matrix. As a result, when the television set was ON and the back of the hand was moved across the surface of the transparent conducting film, there was an unpleasant sensation as if the hand was shaking.

The above manufacturing method was also associated with two other problems insofar as concerned the manufacturing process and film performance.

Regarding the manufacturing process, the baking of the film requires a new furnace to be installed. The baking condition of 150° C. must be maintained for 30 minutes, and the addition of this step demands that a furnace length of 50–100 m be allowed for continuous processing, although the actual required length differs depending on the capacity of the production line and the size of the cathode ray tube to be manufactured. The addition of this furnace to the production line was therefore a great disadvantage from the viewpoint of the space that is required.

Regarding film performance, the film had to be baked at a temperature no greater than 200° C. once it had been formed on the finished cathode ray tube, so as not to adversely affect the reliability or lifetime of the tube. In the case of conventional anti-static tubes, however, the strength of the transparent conducting film was inadequate. For $SiO_2$ (silica) films, the strength of the film increases with the baking temperature, and at temperatures of 350° C. or over, it is almost the same as that of glass. Because of the above restrictions, however, film strength was insufficient. Moreover, applying a further heat treatment to the tube once it had been manufactured entailed considerable energy losses.

FIG. 11 shows the spin-coating process in the conventional method of manufacturing an anti-static cathode ray tube. Anti-implosion treatment is first carried out with the metal anti-implosion band. After the external surface of the face plate 104 has been cleaned, the funnel 113 of the tube is supported on the platform 118 of a spin-coating machine 114, and the holes of fixing lugs 9 are fixed on columns 117 such that face plate 104 points upwards. In this position, the tube is rotated at a relatively low speed (e.g. 40–60 rpm), and a certain quantity of coating solution 19 is sprayed onto the external surface of face plate 104 from an injection nozzle 116 above the face plate. Once the coating solution 119 has spread to some extent all over the external surface of the face plate 104, the speed of the spin-coating machine 114 is raised (e.g. to 100–150 rpm) so as to spin the cathode ray tube at high speed, thereby distributing the coating film evenly over the face plate and stabilizing it.

In the above spin coating process, coating solution which splashes off as the cathode ray tube rotates is caught by salvage cap 115.

There were however two problems in the conventional method of manufacturing anti-static cathode ray tubes.

The first problem was that irregularities occured due to uneveness of the coating in one pair of diagonal corners of the face plate 104. In order to make the coating uniform and stabilize it, the cathode ray tube is rotated at high speed. As FIG. 9 shows, however, the rectangular face plate 104 stirs up the air inside the circular salvage cap 115, and further, the degree of air turbulence is different along the long and short sides of the rectangle. As a result, when the tube is rotated in the direction shown by the arrow in FIG. 9, corner irregularities 122 appear due to uneveness of the coating in the upper left and lower right corners. These corner irregularities 122, moreover, could not be elimated by adjusting the rotation speed of the tube or adjusting the viscosity of the coating solution.

The second problem was that drops of coating solution which had splashed off due to high speed rotation of the tube, impinged on the bottom wall 115A of salvage cap 115 from the same oblique angle as the direction of rotation, and then rebounded back toward the funnel 113 of the tube. Because of the air turbulence around the rotating tube, the movement of the drops of the coating solution is disturbed and the drops may adhere to the tube. Adhesion of drops is a serious problem particularly when the adhesion is in the vicinity of high voltage button 105, leading to high voltage leaks.

SUMMARY OF THE INVENTION

This invention was conceived to overcome the above problems. It provides a method of manufacturing an anti-static cathode ray tube wherein conducting filler particles are dispersed in an $SiO_2$ (silica) matrix so as to give improved film strength and stability of surface resistance with time, yet with far less of the sense of vibration and the sense of uneasiness when the television set is operating.

Further objectives of the present invention are that even if an anti-static treatment is added to the conventional manufacturing method, it does not require the installation of a new furnace, there is no loss of heat energy, and the strength of the transparent conducting film is much improved.

In addition, it also aims to provide a method of manufacturing a high quality anti-static cathode ray tube, wherein the tube is rotated at high speed to give a uniform, stable coating, but without any corner irregularities or adhesion of coating solution which has once splashed off the tube.

In this invention, the surface resistance of the face plate after baking the smooth, transparent conducting film is arranged to lie within the range $5.0\times10^{7}\Omega$–$1.0\times10^{11}\Omega$ by controlling the quantity of conducting filler particles dispersed in the $SiO_2$ (silica) matrix. As a result, the particles are very uniformly dispersed and the potential distribution on the external surface of the face plate is maintained uniform, so that even if the back of the hand is moved across the face plate of the tube when the set is ON, practically no unpleasant vibration is felt.

Further, the conventional heat treatment of the tube is also made to serve as the baking of the film, so there is no nedd to install another furnace. Further, a high baking temperature is used so a very strong film is obtained.

Moreover, in this invention, when the cathode ray tube is rotated to make the conducting coating solution sprayed onto the external surface of the face plate uniform, the salvage cap is made to rotate in synchronization with the tube. The air inside the salvage cap therefore also rotates together with the tube, and there is practically no air turbulence set up by the rectangular face plate. As a result, the formation of corner irregularities due to unevenness of the coating in diagonal corners of the face plate, and adhesion of splashed coating solution onto the funnel are fairly suppressed.

BRIED DESCRIPTION OF DRAWINGS

DETAILED DESCRIPTION OF THE EMBODIMENTS

An embodiment of this invention will now be described with reference to the drawings.

FIG. 1 is an enlargement of the structure of the transparent conducting film of anti-static cathode ray tube in an embodiment. In the figure, 1 is an $SiO_2$ (silica) matrix which comprises a conducting filler of minute particles of $SnO_2$ (stannic oxide) or $In_2O_3$ (indium oxide) or a mixture of them dispersed in an alcohol solution of an Si (silicon) alkoxide with functional groups —OH and —OR, of which size is preferably in the order of 0.1 microns, and minute quantity of P (phosphorus) or Sb (antimony) added to confer semiconducting properties, of which quantity is preferably about 0.1 parts by weight in terms of their oxide. 2 represents conducting filler particles in the matrix 1.

Figure 5:
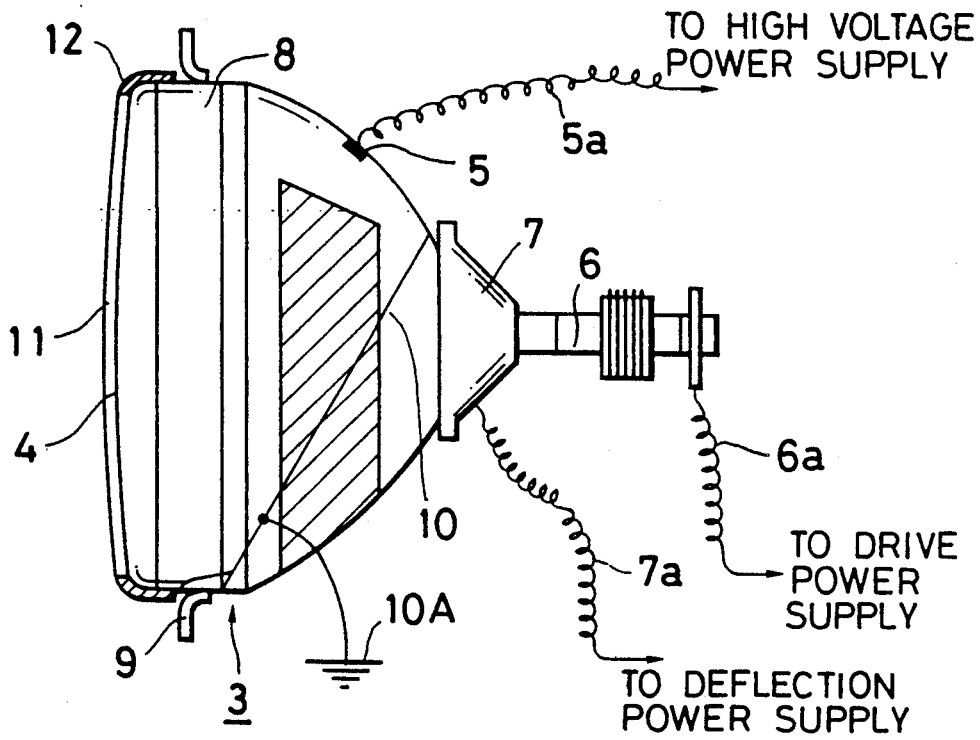
FIG. 5 PRIOR ART
FIG. 5 is a diagram explaining how charge build-up is prevented in an anti-static cathode ray tube.
Figure 6:
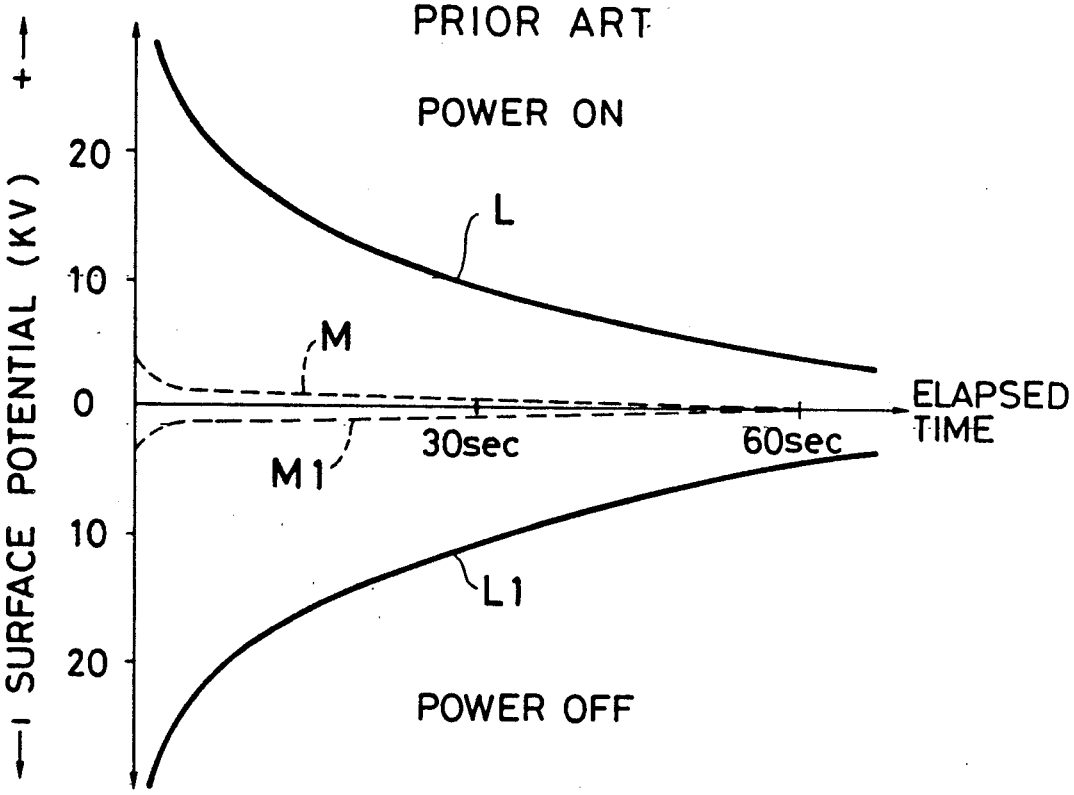
FIG. 6 PRIOR ART
FIG. 6 is a graph showing the potential variation on the external surface of the face plate of a cathode ray tube.

In a wet process such as spin-coating of the above $SiO_2$ (silica) solution, the solution is coated onto the face plate 4 of the cathode ray tube, dried, and then baked so as to form a smooth, thransparent conducting film 11 as in FIG. 5. In this process, the surface resistance (Rs) after the baking step is arranged to lie within the range: $5.0\times10^{7}\Omega \leqq Rs \leqq 1.0\times10^{11}\Omega$.

Description is now made on some experiments performed by the inventor on the anti-static cathode ray tube with a transparent conducting film 11 having the structure shown in FIG. 1, and the results of these experiments.

Figure 4:
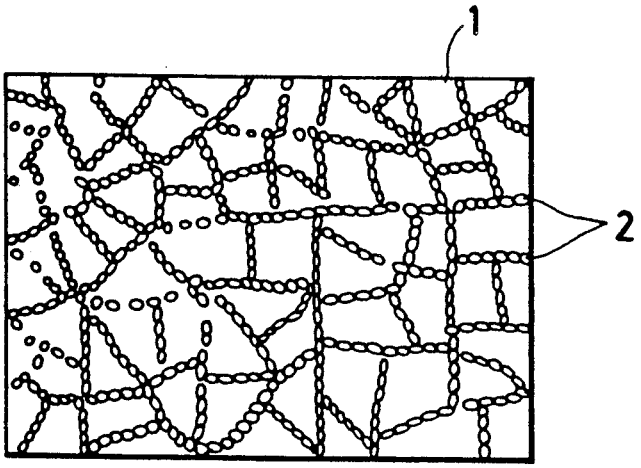
FIG.4 PRIOR ART
FIG. 4 is an enlarged diagram of the structure of the transparent conducting film in a conventional anti-static cathode ray tube.

As described above, if the quantity of conducting filler such as $SnO_2$ (stannic oxide) dispersed in an alcohol solution of an Si (silicon) alkoxide is increased, the solution being coated onto the face plate of a cathode ray tube by a wet proces such as spin-coating and then dried, the particles of the conducting filler quickly cohere together to form a chain-like meshwork shown in FIG. 4 which is undesirable. Prototype anti-static cathode ray tubes were therefore manufactured varying the quantity of conducting filler particles in the alcohol solution of the Si (silicon) alkoxide, the tubes installed in television sets, and the sets tested in operation to evaluate the feeling of vibration experienced.

Figure 1A:
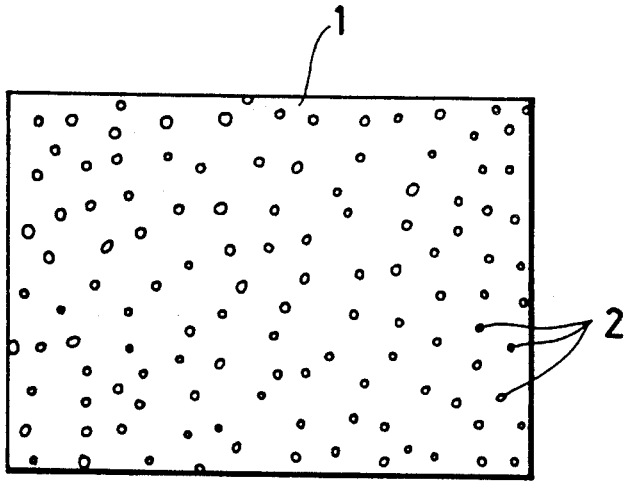
FIG. 1 is an enlarged diagram of the structure of the transparent conducting film in an anti-static cathode ray tube in one embodiment of this invention.
Figure 1B:
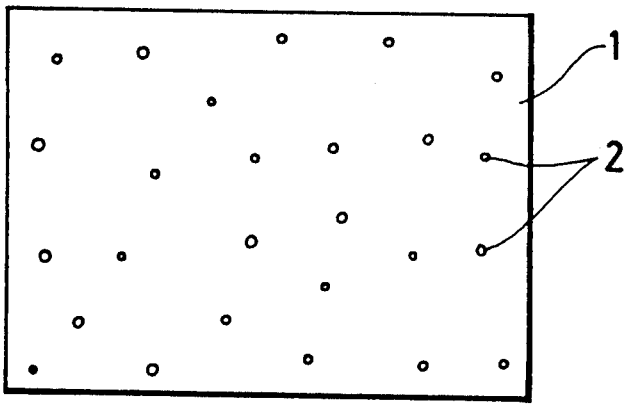
Figure 2:
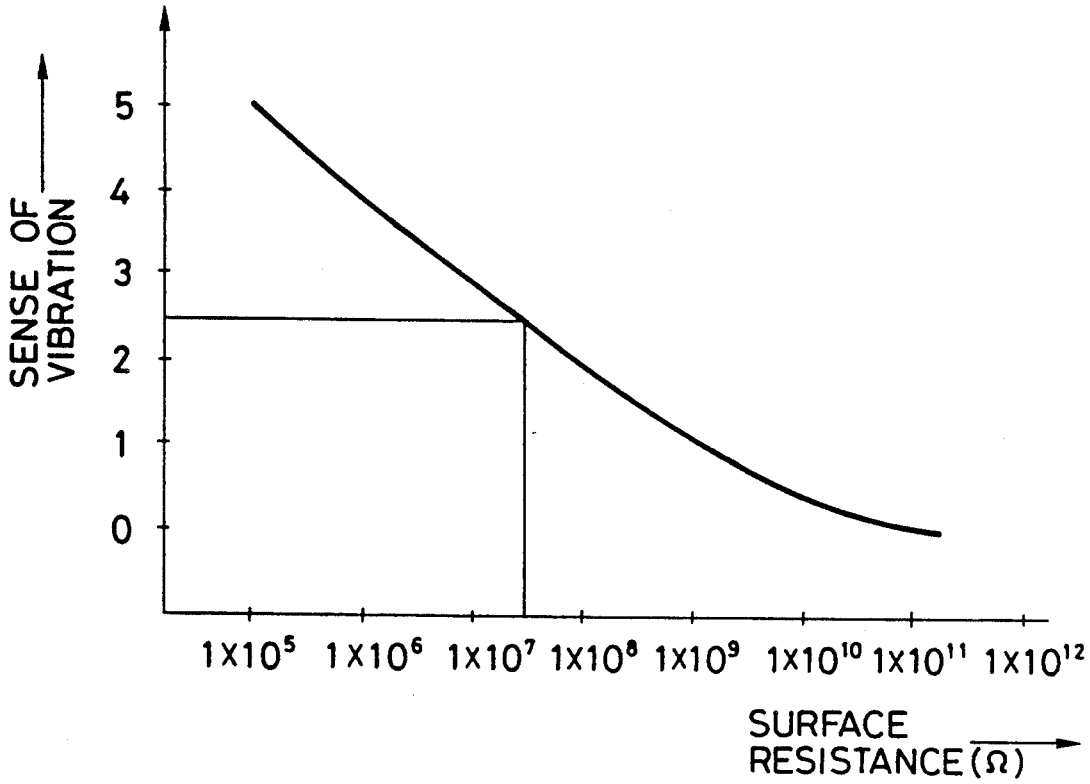
FIG. 2 is a diagram showing the results of tests of surface resistance, and the feeling of vibration experienced when the external surface of the face plate is touched.

FIG. 2 shows the result of these vibration tests. As the amount of conducting filler added is related to the surface resistance of the smooth, transparent conducting film after baking, the quantity of filler added is expressed in terms of the surface resistance of the film. Further, as shown in the figure, the vibration experienced is assigned 6 levels from 0 to 5. At level 0, no vibration at all is felt; while at level 5, a very strong vibration is felt. It was established that when the tubes were installed in television sets, a vibration level of 2.5 or less presented practically no problem in usage. The surface resistance of the smooth, transparent conducting film in this case was $5.0\times10^{7}\Omega$. When this film was observed microscopically, it was found that, as shown in FIG. 1A, the particles of conducting filler 2 were dispersed uniformly in the $SiO_2$ (silica) matrix 1, and there was practically no chain-like meshwork. Further, as the amount of filler 2 added was reduced, the vibration fell almost to zero at a surface resistance of $1\times10^{11}\Omega$. When however the amount of filler 2 was reduced beyond this, as shown in FIG. 1B, the filler became sparsely distributed in $SiO_2$ (silica) matrix 1, and surface resistance fluctuated more widely over the face plate and between different tubes, which is undesirable from the viewpoint of the anti-static effect.

From the above results, therefore, it was found that when a dispersion of a conductor filler in an alcohol solution of an Si (silicon) alkoxide was coated onto the face plate of cathode ray tube by a wet process such as spin-coating and then dried, and the surface resistance (Rs) of the smooth, transparent conducting film produced by baking the dry film was controlled so as to lie in the range $5.0\times10^{7}\Omega\leqq Rs\leqq1.0\times10^{11}\Omega$, all properties of the film were very satisfactory.

In the above embodiment, a dispersion of a conducting filler such as $SnO_2$ (stannic oxide) or $In_2O_3$ (indium oxide) in an alcohol solution of an Si (silicon) alkoxide is used as the coating solution, but the same effect is obtained if a similar solution is used with other metal atoms such as Zr (zirconium) combined in the alkoxide structure.

A further embodiment of this invention will be described below with reference to the drawings.

Figure 3:
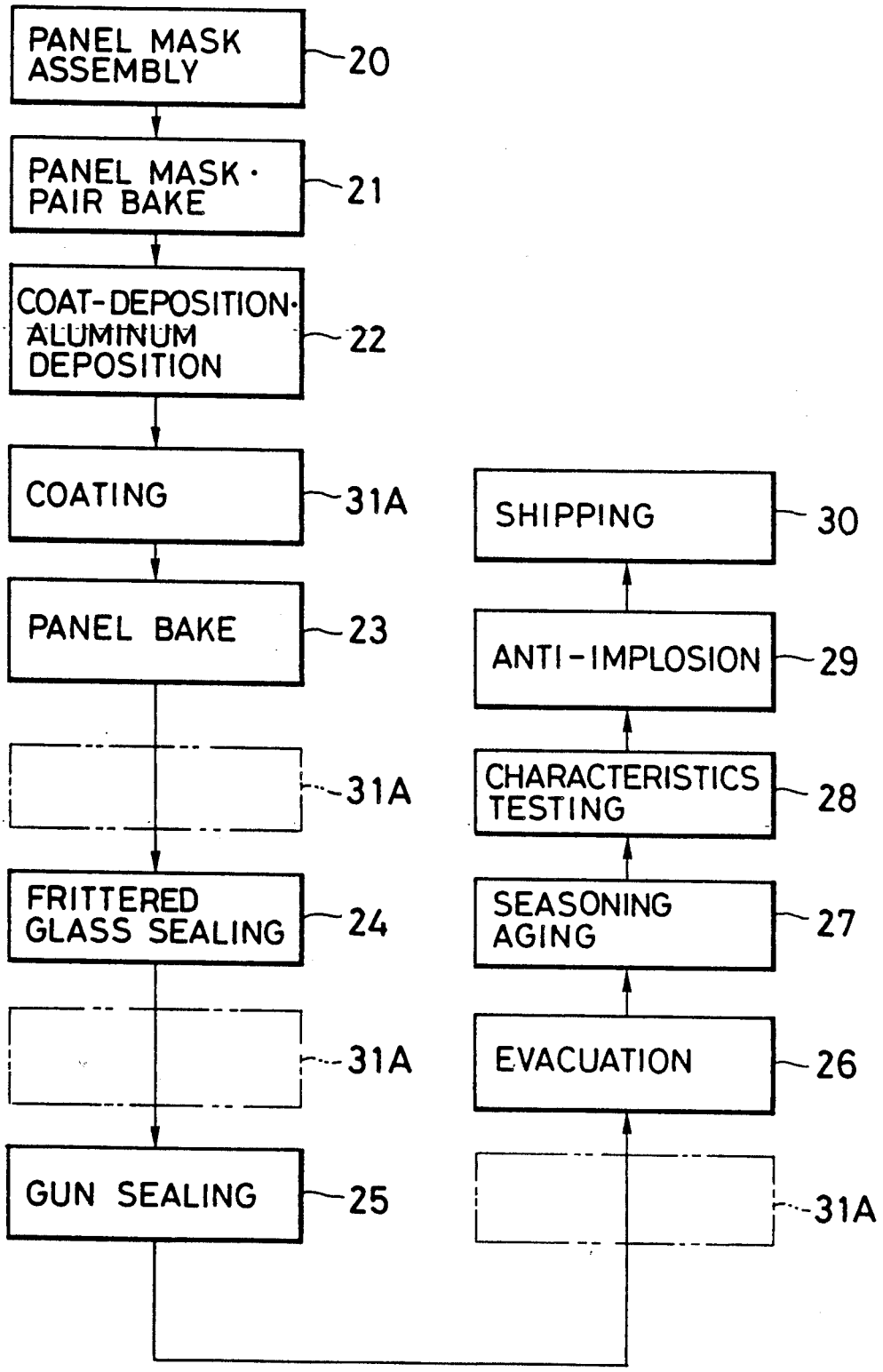
FIG. 3 is a flow chart showing an outline of the process steps used to manufacture the anti-static cathode ray tube of this invention.
Figure 7A:
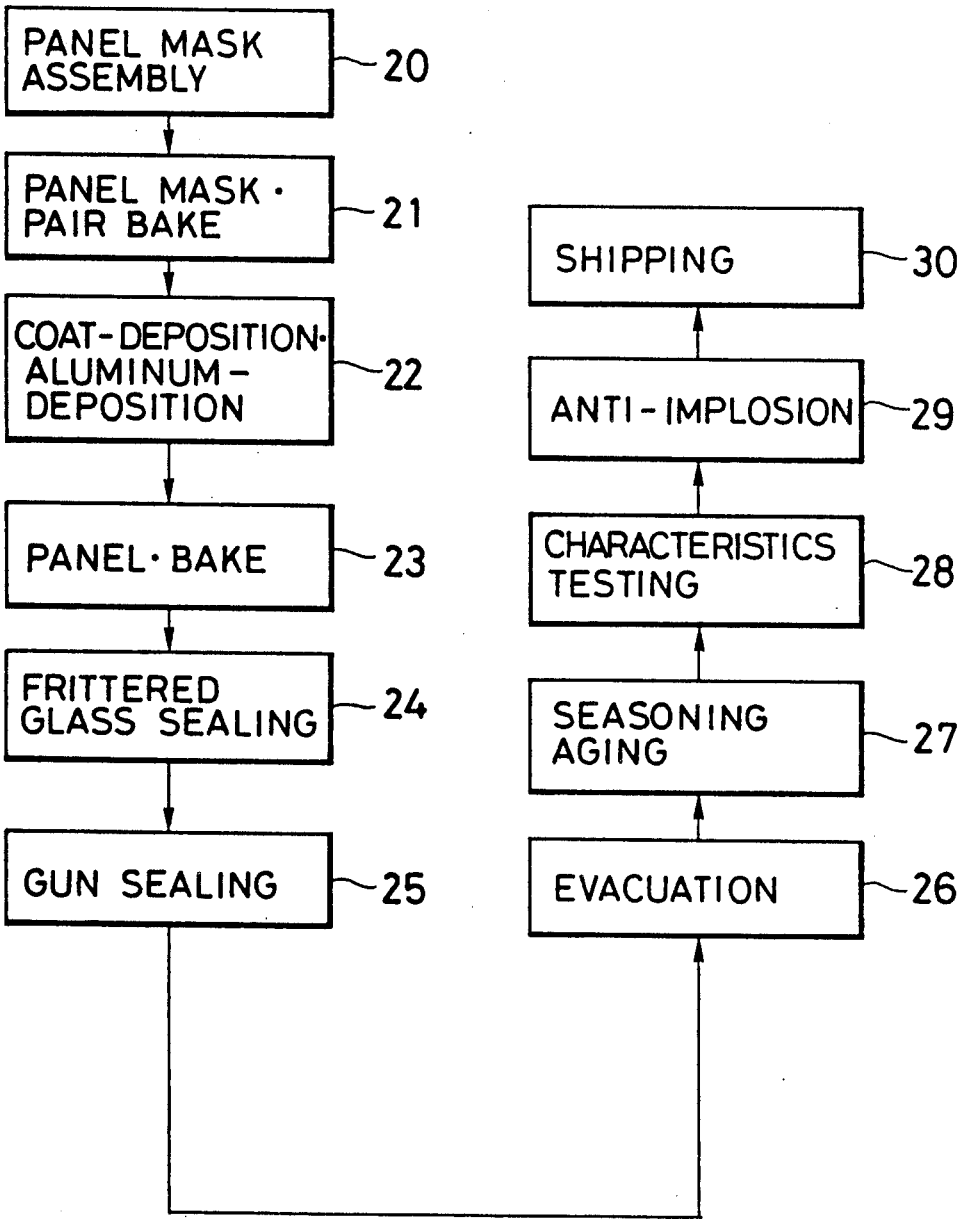
FIG. 7A PRIOR ART
FIG. 7A and 7B are flowcharts showing outlines of the process steps used to manufacture a conventional cathode ray tube and an anti-static cathode ray tube.
Figure 7B:
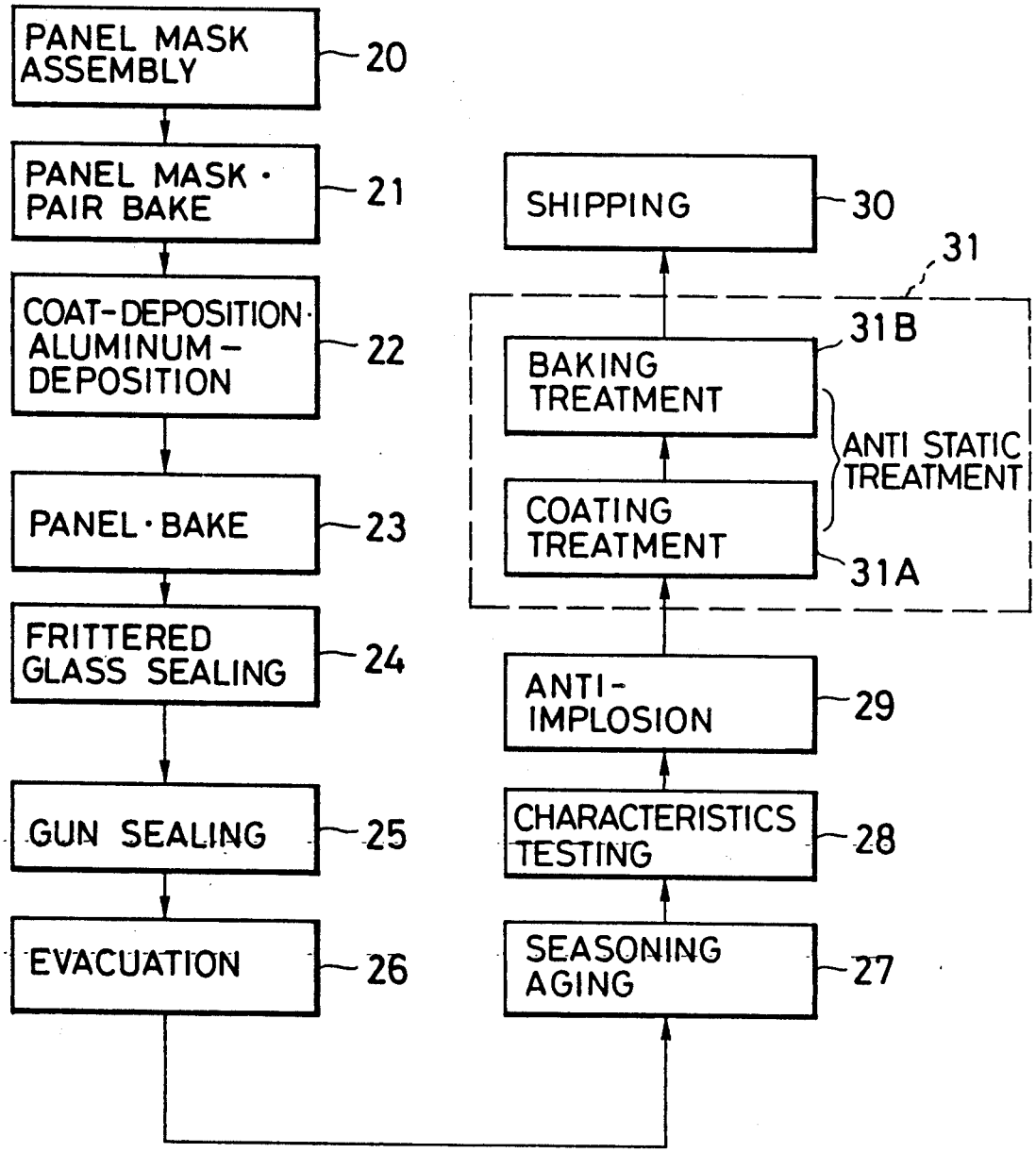
FIG. 7B PRIOR ART

FIG. 3 is an outline diagram of the process steps used to manufacture that anti-static cathode ray tube of this invention. In the FIG, the difference from the conventional manufacturing method shown in FIG. 7B is that instead of the anti-static treatment 31 between the anti-implosion process 29 and shipment 30, the coating step 31A of the anti-static treatment is carried out before the panel bake 23 which is a heat treatment inherent in the manufacture of cathode ray tubes, and the baking step of the anti-static treatment is carried out at the same time as the panel bake 23. As the other process steps are identical to FIG. 7B, they are given the same numbers and their description has been omitted.

The baking step of the anti-static treatment also be carried out at the same time as frittered glass sealing 24 or evacuation 26 instead of the panel bake 23. These heat treatments are both carried out at very high temperatures of 380° C. –450° C., so as shown by the phantom line boxes in FIG. 3, therefore, the coating step 31A may be carried out before process steps 24 or 26, and the baking step is integrated in the latter process steps.

The baking step of the anti-static treatment could, theoretically, be integrated in the panel-mask pair-bake 21 which is also carried out at high temperature. Subsequent to panel-mask pair-bake 21, however, the tube is subjected to a chemical treatment, i.e., coat-deposition and aluminum deposition 22. As the film could be easily attacked by the alkali or acid used or scratched by the frequent handling of materials in process 22, therefore, it is not desirable to integrate the baking step in the panel-mask pair-bake.

Further, as the above gun sealing 25 and evacuation 26 are continuous process steps, the coating step 31A could be carried out before gun sealing 25 as shown by the hypothetical box in FIG. 3, in which case the baking step of the anti-static treatment would be carried out in the evacuation 26.

A further embodiment of this invention will be described with reference to the drawings below.

Figure 8:
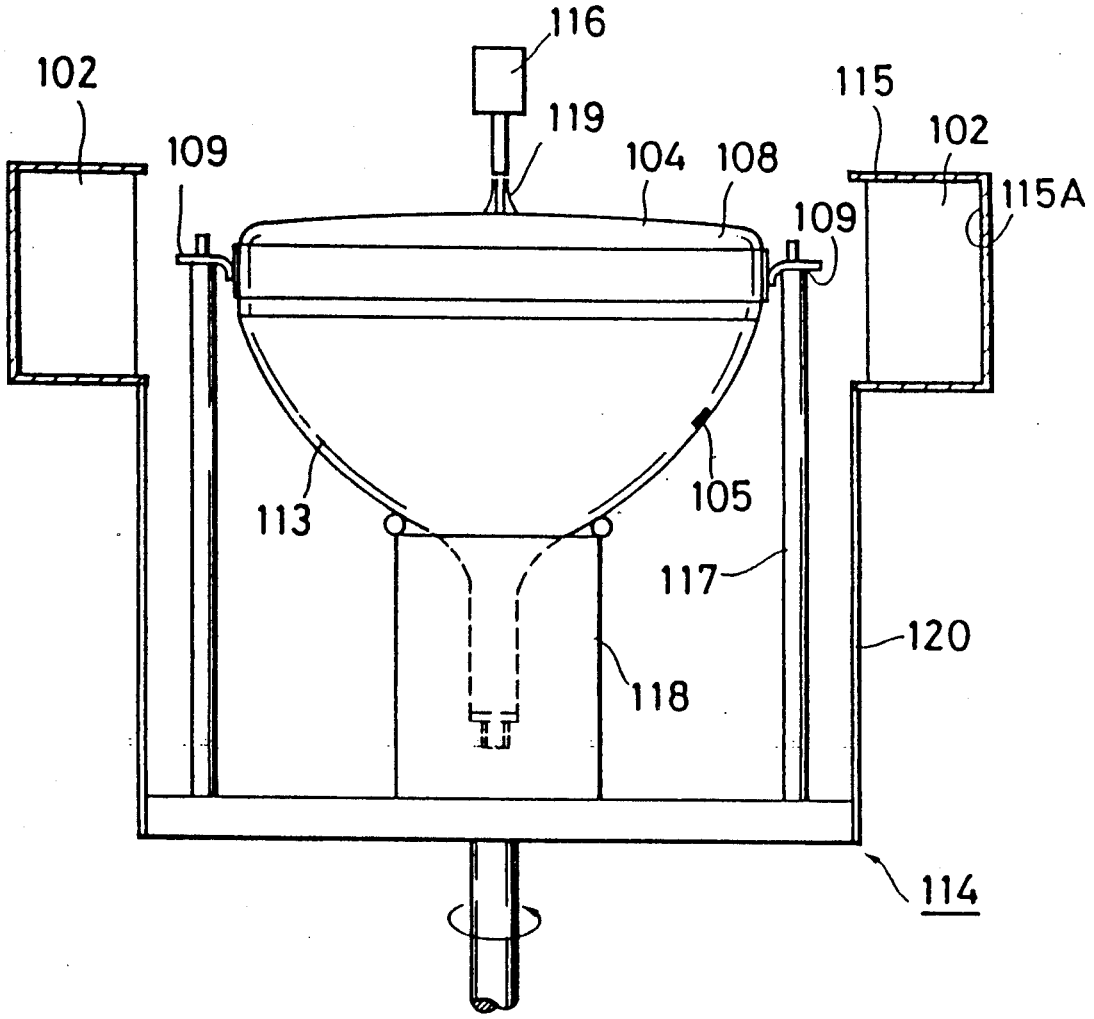
FIG. 8 is a schematic front view of the spin-coating process in the method of manufacturing an anti-static cathode ray tube in another embodiment of this invention.

FIG. 8 is a schematic front view of the spin-coating process in the method of manufacturing an anti-static cathode ray tube in this embodiment of this invention. It differs from the conventional process shown in FIG. 11 in the following points.

Firstly, the salvage cap 115 surrounding the cathode ray tube supported in spin-coating machine 114, is fixed to the machine 114 by arms 120.

In the above construction, the salvage cap 115 is driven by the rotation of spin-coating machine 114, and rotates at high speed together with the tube and in synchronization with it. When, therefore, the tube is rotated at high speed to make the coating uniform and stable, the air inside salvage cap 115 rotates together with the tube. As a result, the face plate 104 no longer sets up turbulence of air inside the cap 115, the coating in diagonal corners of the face plate 104 is uniform, and there is practically no formation of corner irregularities. Further, the drops of coating solution which splash off due to the high speed rotation adhere onto the tube only be a very small extent. Accordingly, faults due to high voltage leaks, caused by adhesion of drops of coating solution to funnel 113 in the vicinity of high voltage button 105, are suppressed.

Figure 9:
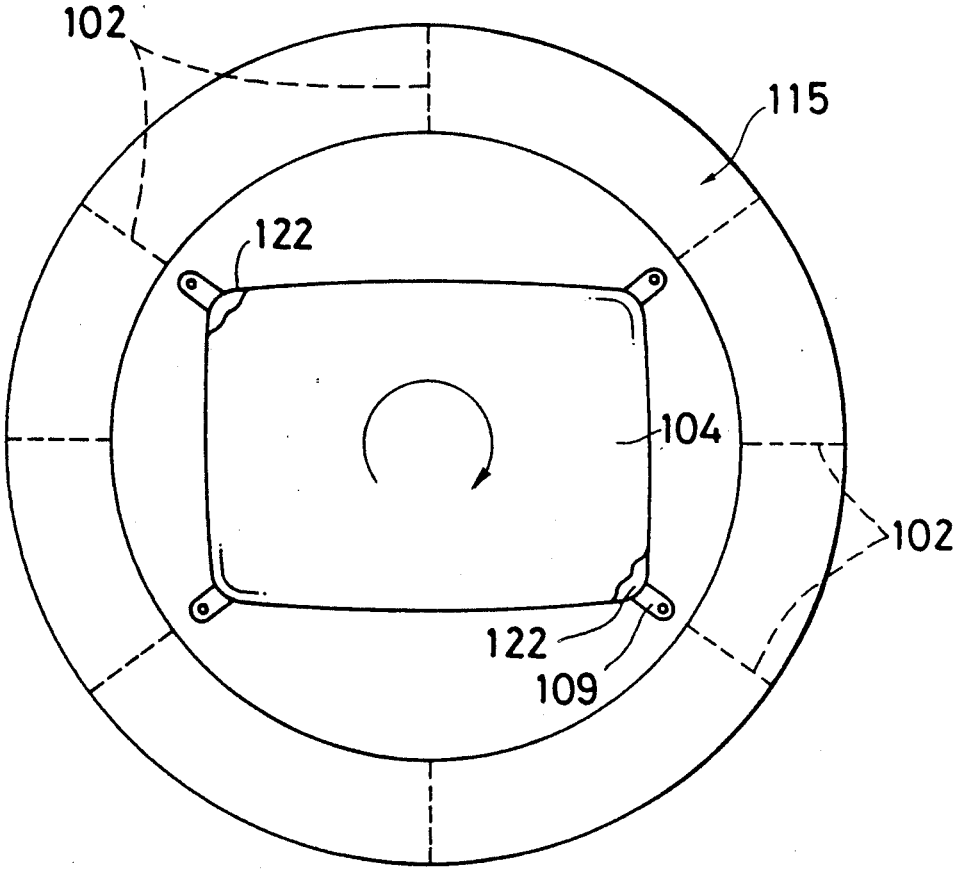
FIG. 9 PRIOR ART
FIGS. 9 and 10 are plan views of the spin-coating machine.
Figure 10:
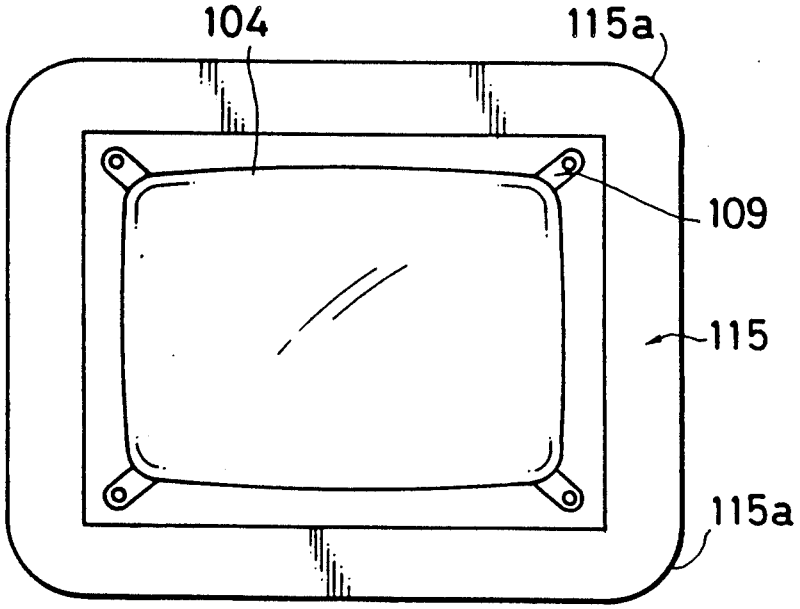

The salvage cup 115 may have a circular shape as shown in FIG. 9, or it may have a rectangular shape substantially very similar to that of face plate 104 as shown in FIG. 10.

If the salvage cap 115 has a circular shape as shown in FIG. 9, several anti-turbulence partitions 102 may be arranged so as to extend in a radial direction and spaced at substantially equal intervals circumferentially, thereby helping to prevent air turbulence in the cap.

Moreover, if salvage cap 15 has a rectangular shape as shown in FIG. 10, no air turbulence at all is set up inside the cap. In the case of a rectangular cap, the corners 115*a* of the bottom walls may also be given a curved surface so as to further reduce the rebounding of drops of coating solution.

Figure 11:
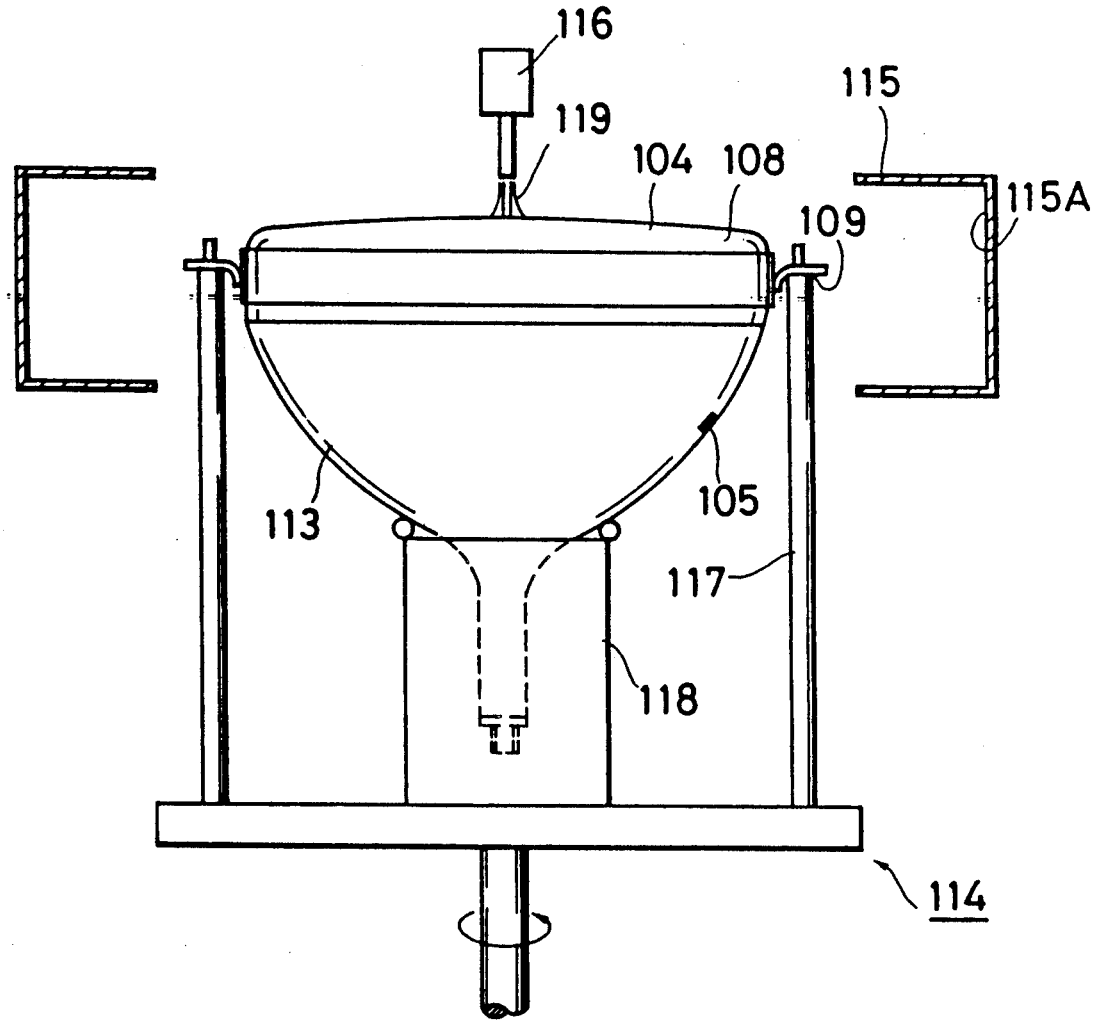
FIG.11 PRIOR ART
FIG. 11 is a schematic front view of the conventional spin-coated process.

As, excepting the above points, the construction and action of parts in the spin-coating assembly are identical to those in the conventional case shown in FIG. 11, they are given the same numbers and their description shall be omitted.

In the above embodiment, description was made on the case where spin-coating of coating solution 119 to form a film is carried out on a cathode ray tube which has received anti-implosion treatment with a metal band 108. The invention however has a similar effect to that in the above embodiment even if the spin-coating is carried out before the tube has received anti-implosion treatment, or on the face plate 104 of the tube alone.

What is claimed is:

1. A method of manufacturing anti-static treated cathode ray tubes, which comprises the steps of:

coating a face plate of said tube with a coating solution containing minute particles of a conducting filler selected from stannic oxide, indium oxide, and mixtures thereof, dispersed in an alcoholic solution of a silicon alkoxide with functional groups—OH and—OR, and additives to confer semiconducting properties to form a coated face plate;

baking said coated face plate to decompose the silicon alkoxide in said coating to silicon and to form a smooth, transparent conducting film on an external surface of said face plate;

wherein a concentration of said filler is so set that a surface resistance of said external surface of said face plate after said step of baking lies within a range from $5.0\times10^{7}\Omega$ to $1.0\times10^{11}\Omega$.

2. A method as recited in claim 1, wherein said conducting filler is $SnO_2$ (stannic oxide) or $In_2O_3$ (indium oxide) or a mixture of them.

3. A method as recited in claim 2, wherein said conducting fillers are in the form of particles of about 0.1 microns in size.

4. A method as recited in claim 1, wherein said additive to confer semiconducting properties is P (phosphorus) or Sb (antimony).

5. A method as related in claim 4, wherein said additive is about 0.1 parts by weight in terms of their oxide in quantity.

6. A method as recited in claim 1, wherein a temperature of said heat treatment is within a range from 380° C. to 450° C.

7. A method as recited in claim 1, wherein said step of coating is carried out just before a gum sealing in said tube.

8. A method as recited in claim 1, wherein said step of coating is carried out by spin coating.

9. A method of manufacturing anti-static treated cathode ray tubes, which comprises the steps of:

supporting said tube such that its face plate points upwards;

rotating said cathode ray tube utilizing a spin coating machine;

injecting a coating solution containing minute particles of a conducting filler selected from stannic oxide, indium oxide, and mixtures thereof, dispersed in an alcoholic solution of a silicon alkoxide with functional groups—OH and—OR, and additives to confer semiconducting properties, onto an external surface of said face plate while said tube is rotated; and rotating a salvage cap which surrounds said cathode ray tube in synchronization with said tube.

10. A method as recited in claim 9, wherein said salvage cap is fixed relative to a rotating part of said spin coating machine.

11. A method as recited in claim 9, wherein said salvage cap is driven by the rotation of said rotating part of said spin coating machine.

12. A method as recited in claim 9, wherein said salvage cap is of a circular shape.

13. A method as recited in claim 12, wherein said salvage cap with said circular shape has several anti-turbulence partitions which is arranged so as to extend in a radial direction and spaced at substantially equal intervals circumferentially.

14. A method as recited in claim 9, wherein said salvage cap has a rectangular shape very similar to that of said face plate.

15. A method as recited in claim 14, wherein said salvage cap with said rectangular shape is given a curved surface in the corners of the side walls.

16. A method as recited in claim 1, wherein said step of coating said external surface of said face plate is carried out prior to panel baking frittered glass sealing, or evacuation of said tube.

* * * * *